US006731024B1

(12) United States Patent
Molnar et al.

(10) Patent No.: US 6,731,024 B1
(45) Date of Patent: May 4, 2004

(54) MOTION SENSOR-CONTROLLED POWER STRIP

(76) Inventors: Steven A. Molnar, 6083 Rogers Cir., Golden, CO (US) 80403; Virginia A. Molnar, 6083 Rogers Cir., Golden, CO (US) 80403

( * ) Notice: Subject to any disclaimer, the term of this patent is extended or adjusted under 35 U.S.C. 154(b) by 16 days.

(21) Appl. No.: 10/274,481

(22) Filed: Oct. 21, 2002

(51) Int. Cl.[7] ..... H01B 7/30
(52) U.S. Cl. ..... 307/147; 307/38; 307/116
(58) Field of Search ..... 301/147, 38, 116, 301/40, 115; 439/638, 639, 650, 651, 633, 654, 676, 620; 361/152, 153; 379/502

(56) References Cited

U.S. PATENT DOCUMENTS

| | | | | |
|---|---|---|---|---|
| 1,788,111 | A | | 1/1931 | Knowles |
| 2,654,074 | A | | 9/1953 | Lancelot |
| 3,421,013 | A | | 1/1969 | Angelari |
| 4,209,728 | A | | 6/1980 | Membreno |
| D269,072 | S | | 5/1983 | Sweet et al. |
| D310,063 | S | | 8/1990 | Cheng |
| 5,036,443 | A | | 7/1991 | Humble et al. |
| 5,157,273 | A | * | 10/1992 | Medendorp et al. ..... 307/147 |
| 5,258,899 | A | | 11/1993 | Chen |
| D342,334 | S | | 12/1993 | Vakil |
| 5,307,054 | A | | 4/1994 | Concannon, Sr. et al. |
| 5,397,929 | A | | 3/1995 | Hogarth et al. |
| 5,442,532 | A | | 8/1995 | Boulos et al. |
| 5,465,198 | A | | 11/1995 | Kellogg |
| 5,590,953 | A | | 1/1997 | Haslam et al. |
| 5,973,414 | A | | 10/1999 | Båberg |

* cited by examiner

*Primary Examiner*—Gregory J. Toatley, Jr.
(74) *Attorney, Agent, or Firm*—Donald R. Schoonover

(57) ABSTRACT

A power strip having a plurality of grounded outlet receptacles includes a motion sensor circuit. The motion sensor circuit controls operation of the power strip, and hence, operation of all electronic components plugged into the power strip.

3 Claims, 3 Drawing Sheets

MOTION SENSOR-CONTROLLED POWER STRIP

BACKGROUND OF THE INVENTION

1. Field of the Invention

The present invention relates to the general art of electrical outlets, and to the particular field of power strips.

2. Discussion of the Related Art

Many people enjoy decorating their homes and gardens. This is especially true during Christmas time as well as other holidays. People often attach lights and other electrical elements to their homes and place lights and other electrical elements around their homes. Many people also like to decorate their homes and gardens for parties or for simple landscaping reasons. Some people also like to locate a plurality of various electrical elements on and around their homes for security purposes.

The decorations are often beautiful and interesting and the security elements are often quite effective. However, they are often difficult and time consuming to erect and remove. Cords become tangled, frayed or even shorted, and the like. Furthermore, if there are a multitude of different electrical elements involved in the system, many people become overwhelmed at the complexity of the set up. Thus, many people are reluctant to decorate their homes and gardens in manners that otherwise would be enticing.

Therefore, there is need for a versatile means for easily and efficiently connecting a plurality of different elements to a power source. Since many people wish to locate such elements outside, such as in a landscaping situation or a home holiday decoration, or in home security situation, there is need for a such an electrical connection unit that can be used outdoors. Specifically, there is a need for such a means that can be used for holiday decorations, including Christmas decorations and the like as well as such a means that can be used for landscaping and gardening purposes.

Often, such systems are located where they may be contacted by water and many times the home is subject to power surges of various types. In order to protect not only the elements of the overall system, but to protect people who may be near these elements during such a power surge, any means for electrically connecting such elements to power should include a surge protector circuit.

Since many people are conscious of saving energy, they may wish the decorations erected on and around their home to be active only at certain times. Thus, it would be advantageous if such decorations were only activated when desired and de-activated at all other times. This is also true if the electrical elements are being used for security purposes. For example, a home owner may want certain lights to go on when someone approaches their home, but to be off at all other times. This result is best achieved if the electrical elements are controlled by a motion detector. However, equipping each element of a system with a motion detector may create problems. These problems include cost as well as complexity. If each item of an overall system is equipped with its own motion detector, there is much room for failure.

Therefore, there is need for a means for efficiently, reliably and economically connecting a plurality of elements of an overall system to a motion detector unit.

While a homeowner may wish an overall system to be on some of the time and off at other times, that homeowner may wish to have a motion controlled system at still other times. Therefore, there is need for a means for connecting a plurality of different elements to power in a manner that can be operated in a plurality of different modes and can be switched between the various different modes.

PRINCIPAL OBJECTS OF THE INVENTION

It is a main object of the present invention to provide a versatile power connection.

It is another object of the present invention to provide a power connection that can be used outdoors.

It is another object of the present invention to provide a power connection that includes a surge protector circuit.

It is another object of the present invention to provide a power connection that includes a motion detector unit.

It is another object of the present invention to provide a power connection that can be operated in a plurality of different modes.

It is another object of the present invention to provide a power connection that can be switched between various different modes of operation.

It is another object of the present invention to provide a power connection that is suitable for use with Christmas lights.

It is another object of the present invention to provide a power connection that is suitable for garden and landscaping use.

SUMMARY OF THE INVENTION

These, and other, objects are achieved by a power strip which comprises a housing; a plurality of electrical outlet receptacles on the housing, each outlet receptacle including a grounded connection; a power cord which can be connected to a source of power; a motion sensor circuit electrically connected to each of the electrical outlet receptacles; a surge protector circuit electrically connected to each of the electrical outlet receptacles; a control switch on the housing. The control switch having three mutually exclusive positions including an "off" position which electrically disconnects the electrical surge protector circuit from power when the control switch is in an "off" condition, an "on" position which electrically connects the electrical surge protector circuit to power when the control switch is in an "on" condition, and a "motion" position which electrically connects the motion sensor circuit to power when the control switch is in a "motion" condition; and an anchor on the housing. The anchor being sized and shaped to fix the housing to the ground and may be electrically connected to the ground when the anchor is fixed to the ground. The power strip further includes a grounding circuit which electrically connects the grounded connection of each of the electrical outlet receptacles to the ground in the power cord or to the anchor whereby each of the outlet receptacles is grounded.

The power strip can be used either indoors or outdoors and can be used to connect a plurality of elements to power. Thus, Christmas lights, decorative garden and landscaping lights and the like can be connected to power in an easy and expeditious manner. The surge protector circuit of the power strip protects the connected elements from power surges and the motion detector circuit can be used to activate the connected elements only when a person moves in the vicinity of the power strip. This permits the power strip to activate such elements only when a particular effect is desired while saving energy the rest of the time. This also permits the power strip of the present invention to be used for home security to turn on multiple devices, including lights, if someone approaches the home. However, the power strip of the present invention can be used in any one of a plurality of modes so the power strip is quite versatile.

BRIEF DESCRIPTION OF THE DRAWING FIGURES

DETAILED DESCRIPTION OF THE INVENTION

Other objects, features and advantages of the invention will become apparent from a consideration of the following detailed description and the accompanying drawings.

Figure 2:
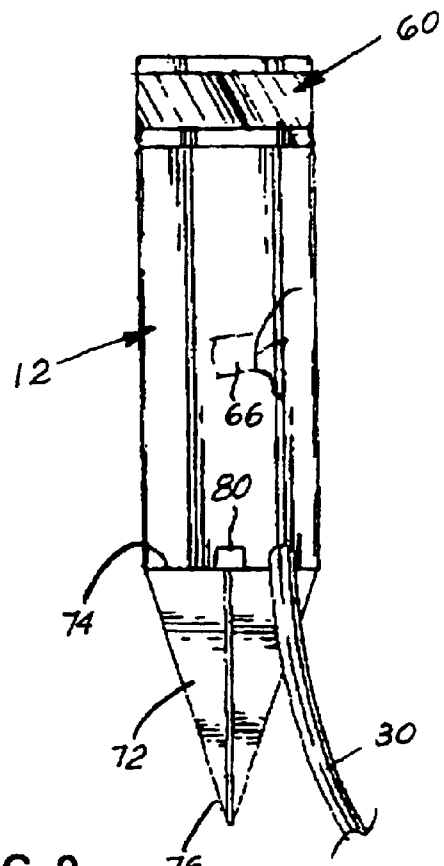
FIG. 2 is a side elevational view of the power strip embodying the present invention.
Figure 1:
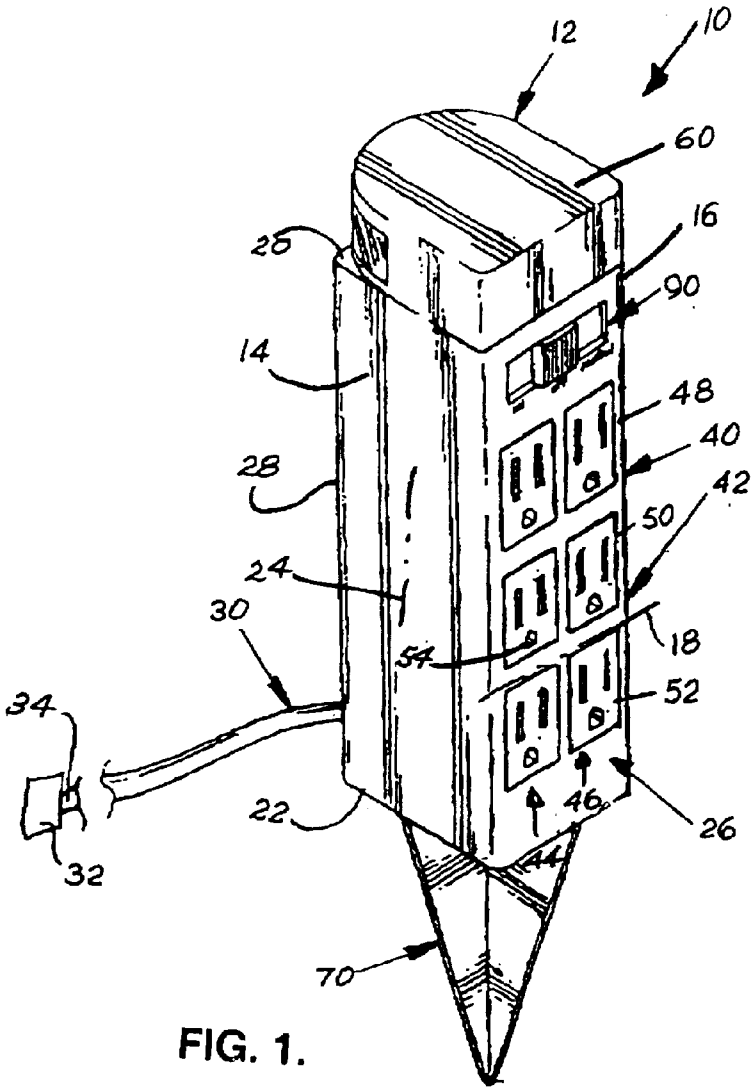
FIG. 1 is a front perspective view of a motion-sensor controlled power strip embodying the present invention.

Referring to FIGS. 1 and 2, and to the following description, it can be understood that the present invention is embodied in an electrical outlet unit 10 which comprises a weatherproof housing 12 which includes a first side 14 and a second side 16. A transverse axis 18 extends between the first side 14 and the second side 16. The housing 12 further includes a first end 20 and a second end 22. A longitudinal axis 24 extends between the first end 20 and the second end 22. Housing 12 further includes a front 26 and a rear 28. Housing 12 can be formed in various colors and of various materials.

A power cord 30 is connected to housing 12 and has a connection 32 on a distal end 34 thereof that is shaped and sized to electrically connect to a power source 36 such as an electrical outlet receptacle of a home, or the like.

A plurality of grounded electrical outlet receptacles such as receptacles 40 and 42 are located on the front 26 of housing 12. In the example shown in FIG. 1, the receptacles are arranged in two columns 44 and 46 and three rows 48–52. As can be understood from FIG. 1, the columns 44, 46 are spaced apart from each other along the transverse axis 18 of the housing 12 and the rows 48–52 are spaced apart from each other along the longitudinal axis 24 of the housing 12. Each outlet receptacle has a ground connection, such as ground connection 54.

Unit 10 includes a motion sensor unit 60 on housing 12, and preferably on top 20 of the housing 12. Motion sensor unit 60 includes a motion sensor circuit electrically connected to each outlet receptacle of the plurality of grounded electrical outlet receptacles to control operation of those receptacles as will be understood from the teaching of this disclosure.

An electrical surge protector circuit 66 is located in housing 12 and is electrically connected to each outlet receptacle of the plurality of grounded electrical outlet receptacles. The surge protector circuit 66 is common to power strips and thus will not be further discussed as those skilled in the art will understand what elements and connections are required for the surge protector circuit 66.

A support anchor 70 is located on the second end 22 of the housing 12 and includes a plurality of triangular blades, such as blade 72. Each blade has a base 74 fixedly attached to the second end 22 of the housing 12 and an apex 76 spaced apart from the second end 22 of the housing 12 along the longitudinal axis 24 of the housing 12. The apexes 76 of the triangular blades 72 are located adjacent to each other and define a leading point 76 for the support anchor 70. The leading point 76 of the support anchor 70 guides the support anchor 70 into the ground when the unit 10 is driven into the ground. The blades 72 may be constructed of the same material as the housing 12, i.e., may be formed integrally with the housing 12, or each of the blades 72 of the support anchor 70 may be constructed of conductive material, such as metal or other suitable arrangement, and be in electrical contact with the ground when inserted into the ground to form a grounding element for unit 10.

A grounding circuit 80 electrically connects the grounding circuit of each of the grounded outlet receptacles to the grounded conductor of the power cord or a metal support anchor 70 to ground each outlet receptacle.

Figure 5:
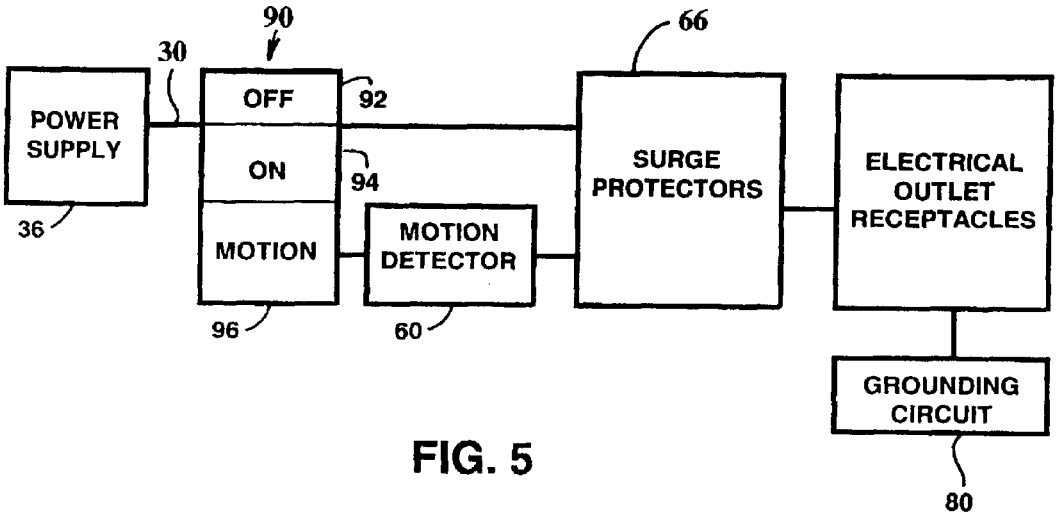
FIG. 5 is a block diagram indicating the modes of operation of the power strip embodying the present invention.

A control switch 90 is located on the housing 12. As indicated in FIGS. 1 and 5, control switch 90 is electrically interposed between power 36 and the electrical surge protector circuit 66 and between power 36 and the motion detector circuit 60. Switch 90 includes an "off" position 92 which electrically disconnects the electrical surge protector circuit 66 from power 36 when the control switch 90 is in an "off" condition, an "on" position 94 which electrically connects the electrical surge protector circuit 66 to power 36 when the control switch 90 is in an "on" condition, and a "motion" position 96 which electrically connects the motion sensor unit 60 to power 36 when the control switch 90 is in a "motion" condition. The "on" position 94 and the "off" position 92 and the "motion" position 96 of the control switch 90 are mutually exclusive of each other so that when the control switch 90 is in one of the positions, it cannot be in any other of the positions. That is, if the control switch 90 is in an "on" configuration, the motion sensor unit 60 will not be activated and the electrical outlet receptacles will be powered at all times and so forth for the other positions of the control switch 90.

Figure 3:
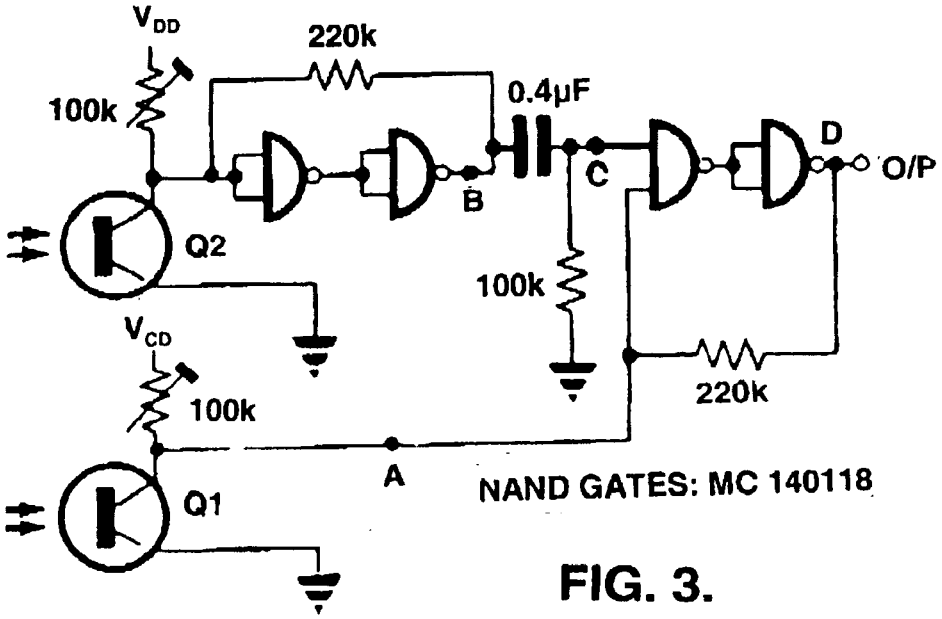
FIG. 3 is a circuit schematic of a motion sensor circuit that can be used in the power strip embodying the present invention.
Figure 4:
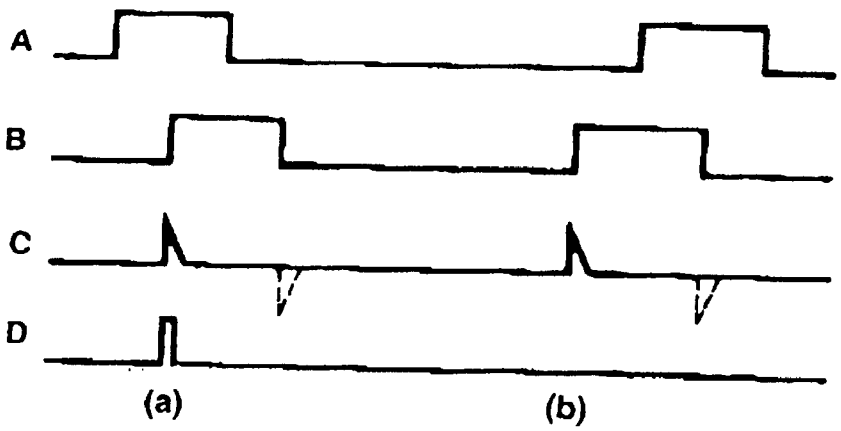
FIG. 4 is a schematic illustrating the operation of the motion sensor circuit shown in FIG. 3.

A motion sensor circuit 100 is indicated in FIGS. 3 and 4. The circuit 100 shown in FIGS. 3 and 4 detects an object passing in one direction but ignores it going the opposite direction. Two sensors define the sense of direction. The object blocks light to phototransistor Q1 or Q2 first dependent on the direction of approach. When the object passes Q1 then Q2, an output pulse is generated at D; while no pulse is seen at D as the object passes Q2 then Q1.

Object length measured along the direction of the two sensors should be greater than the separation of the two sensors Q1 and Q2. Pulses shown in FIG. 5 correspond to pulses occurring at the corresponding locations shown in FIG. 4.

An alternative form of the invention includes a motion detector circuit that can be removed from housing 12 and located in a position that is spaced apart from housing 12.

Such a motion detector would be connected to the remainder of the circuitry in the unit via either a landline or a wireless communication system.

It is understood that while certain forms of the present invention have been illustrated and described herein, it is not to be limited to the specific forms or arrangements of parts described and shown.

What is claimed and desired to be covered by Letters Patent of the United States is:

1. An electrical outlet unit comprising:

a) a weatherproof housing which includes
(1) a first side,
(2) a second side,
(3) a transverse axis extending between the first side and the second side,
(4) a first end,
(5) a second end,
(6) a longitudinal axis extending between the first end and the second end,
(7) a front, and
(8) a rear;

b) a power cord connected to said housing and having a connection on a distal end thereof that is shaped and sized to electrically connect to a power source whereby elements electrically connected to said power cord are connected to power via said power cord;

c) a plurality of grounded electrical outlet receptacles located on the front of said housing and being arranged in columns and rows, with the columns being spaced apart from each other along the transverse axis of said housing and the rows being spaced apart from each other along the longitudinal axis of said housing, each outlet receptacle having a ground connection;

d) a motion sensor unit on said housing and including a motion sensor circuit electrically connected to each outlet receptacle of said plurality of grounded electrical outlet receptacles;

e) an electrical surge protector circuit in said housing and electrically connected to each outlet receptacle of said plurality of grounded electrical outlet receptacles;

f) a support anchor on the second end of said housing and including
(1) a plurality of triangular blades with each blade having a base fixedly attached to the second end of said housing and an apex spaced apart from the second end of said housing along the longitudinal axis of said housing,
(2) the apexes of said triangular blades being located adjacent to each other and defining a leading point for said support anchor,
(3) each of said blades of said support anchor being in electrical contact with the ground when inserted into the ground, and
(4) a grounding circuit electrically connecting the grounding circuit of each of said grounded outlet receptacles to a grounded conductor of the power cord or to said support anchor;

g) a control switch on said housing, said control switch being electrically interposed between said power cord and said electrical surge protector circuit and including
(1) an "off" position which electrically disconnects said electrical surge protector circuit from power when said control switch is in an "off" condition,
(2) an "on" position which electrically connects said electrical surge protector circuit to power when said control switch is in an "on" condition, and
(3) a "motion" position which electrically connects said motion sensor circuit to power when said control switch is in a "motion" condition; and h) the "on" position and the "off" position and the "motion" position of said control switch being mutually exclusive of each other so that when said control switch is in one of said positions, it cannot be in any other of said positions.

2. The electrical outlet unit as described in claim 1 wherein said motion detector unit is located on the first end of said housing.

3. A power strip comprising:

a) a housing;

b) a plurality of electrical outlet receptacles on said housing, each outlet receptacle of said plurality of outlet receptacles including a grounded connection;

c) a power cord having a connection which is sized and shaped to electrically connect to a power source and via which elements electrically connected to said power cord are electrically connected to power;

d) a motion sensor circuit electrically connected to each of said electrical outlet receptacles;

e) a surge protector circuit electrically connected to each of said electrical outlet receptacles;

f) a control switch on said housing, said control switch having three mutually exclusive positions including
(1) an "off" position which electrically disconnects said electrical surge protector circuit from power when said control switch is in an "off" condition,
(2) an "on" position which electrically connects said electrical surge protector circuit to power when said control switch is in an "on" condition, and
(3) a "motion" position which electrically connects said motion sensor circuit to power when said control switch is in a "motion" condition;

g) an anchor on said housing, said anchor being sized and shaped to fix said housing to the ground and may be electrically connected to the ground when said anchor is fixed to the ground; and h) a grounding circuit which electrically connects the grounded connection of each of said electrical outlet receptacles to the grounded conductor of the power cord or to said anchor.

* * * * *